US008301055B2

(12) United States Patent
Kojima

(10) Patent No.: US 8,301,055 B2
(45) Date of Patent: Oct. 30, 2012

(54) IMAGE FORMING APPARATUS WITH AIR COOLING OF SHEETS THROUGH MULTIPLE DUCTS

(75) Inventor: Ryuichi Kojima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 654 days.

(21) Appl. No.: 12/411,591

(22) Filed: Mar. 26, 2009

(65) Prior Publication Data

US 2009/0252525 A1 Oct. 8, 2009

(30) Foreign Application Priority Data

Apr. 3, 2008 (JP) ..... 2008-097198

(51) Int. Cl.
*G03G 21/20* (2006.01)

(52) U.S. Cl. ..... 399/92

(58) Field of Classification Search ..... 399/341, 399/92, 124, 94
See application file for complete search history.

(56) References Cited

FOREIGN PATENT DOCUMENTS

| | | | |
|---|---|---|---|
| JP | 5-16402 | | 1/1993 |
| JP | 2000-310931 | | 11/2000 |
| JP | 2003-223093 | | 8/2003 |
| JP | 2003-263093 | | 9/2003 |
| JP | 2005321622 A | * | 11/2005 |
| JP | 2006-184549 | | 7/2006 |

OTHER PUBLICATIONS

Computer translation of JP2003-263093A, filed Sep. 19, 2003.*

* cited by examiner

*Primary Examiner* — Quana M Grainger
(74) *Attorney, Agent, or Firm* — Fitzpatrick, Cella, Harper & Scinto

(57) ABSTRACT

A first air blowing portion including an upper duct and a first fan blows air along a first surface of a sheet passing through a sheet conveying path in a direction orthogonal to a sheet conveying direction, and a second air blowing portion including a lower duct and a second fan blows air along a second surface opposed to the first surface of the sheet passing through the sheet conveying path in a direction reverse to the direction orthogonal to the sheet conveying direction of the first air blowing portion, so that both surfaces of the sheet are cooled.

8 Claims, 11 Drawing Sheets

IMAGE FORMING APPARATUS WITH AIR COOLING OF SHEETS THROUGH MULTIPLE DUCTS

BACKGROUND OF THE INVENTION

Field of the Invention

The present invention relates to an image forming apparatus, and more particularly, to an image forming apparatus in which a sheet having a toner image heat-fixed thereon is cooled by blowing air.

Hitherto, in an image forming apparatus such as a copying machine, a laser beam printer, and a facsimile, there is employed one structure where after a developer image (hereinafter referred to as a toner image) formed on an image bearing member is transferred onto a sheet, the sheet is heated to fix the toner image.

In this case, immediately after image fixation the sheet is high in temperature. Accordingly, if an image is formed on a great number of sheets within a short period of time, the high temperature sheets after image fixation are stacked on a delivery tray, and the heat is accumulated within the sheets without being naturally-cooled. As a result, the toner may adhere onto a back surface of the sheet stacked on the image, to thereby cause a stain on the back surface of the sheet. Further, in some cases, there occurs a phenomena where the sheets stick to each other, resulting in markedly degrading an image quality.

For that reason, in order to prevent the sticking between the sheets described above from occurring, in the conventional image forming apparatus, as illustrated in FIG. 9, for example, it is known to have a sheet cooling portion provided with a cooling fan 201 above a delivery tray 200, for forcibly cooling a sheet S. Then, in the sheet cooling portion described above, the air is applied to the sheet S, which is delivered from an image forming apparatus 202 to the delivery tray 200, from above with the cooling fan 201, to thereby cool the sheet S (refer to Japanese Patent Application Laid-open No. 2003-223093).

As illustrated in FIG. 10, for example, there is also known to provide a sheet cooling portion in which heat pipes 212 are connected to discharge roller pairs 211 so as to cool a sheet. Then, in the sheet cooling portion described above, the heat from the discharge roller pairs 211 is radiated through the heat pipes 212 so that the sheet, which just after the image fixation passing between the discharge roller pairs 211, is cooled (refer to Japanese Patent Application Laid-open No. H05-016402).

In addition, as illustrated in FIG. 11, for example, there is known the case in which a fan 230 is provided on a lateral side of a sheet conveying path to cool the sheet. Then, in the sheet cooling portion described above, the sheet, which just after the image fixation passes through the sheet conveying path, is cooled from the lateral side thereof by blowing a cooling air thereto (refer to Japanese Patent Application Laid-open No. 2006-184549).

In recent years, the image formation speed is increased in the image forming apparatus. Along with this, the sheet delivery interval has shortened. As a result, temperatures of the sheets stacked on the delivery tray are also increased. Accordingly, prevention of the stains of the back surface of the sheets, or of the stick of the sheets to each other as described above is hard to be achieved.

Further, in the sheet cooling portion illustrated in FIG. 9, when the sheet is delivered to the delivery tray 200, the air is blown against the entire sheet. However, the air is only blown from above so as to distribute the air to the entire sheet, and hence there occurs an unevenness of the cooling with respect to the already delivered sheets on the delivery tray. For that reason, a cooling effect is incomplete.

Further, since the air is blown from above, only the top surface of the sheet may be cooled, and an undersurface of the sheet is not to be cooled. In view of the recent sheet conveying speed, the prevention of the stains of the back surface of the sheet, or of the stick of the sheets to each other is hard to be achieved by only cooling one surface of the sheet.

Further, in the sheet cooling portion illustrated in FIG. 10, there occurs increases in the cost of the heat pipe itself and costs of a structure and others for connecting the pipes 212 to the discharge roller pair 211. Further, it becomes hard to improve a cooling effect so as to follow the recent conveying speed.

Further, in the sheet cooling portion illustrated in FIG. 11, the cooling effect is improved by directly applying the cooling air to the sheet S. However, the cooling air is applied from one lateral side of the sheet S, and hence the cooling effect at a portion downstream of the cooling air becomes smaller than a portion upstream of the cooling air, resulting in it being impossible to uniformly cool the entire sheet. As a result, owing to the recent increase of the conveying speed, the cooling of the sheet, in particular, at the portion downstream of the cooling air becomes insufficient, resulting in it being difficult to prevent the stains of the back surface of the sheet, or sticking of the sheets to each other, which may occur at that portion.

Further, in the sheet cooling portion illustrated in FIG. 10, there occurs increases in cost of the heat pipe itself and costs of a structure and others for connecting the pipes 212 to the discharge roller pair 211. Further, it becomes hard to improve a cooling effect so as to follow the recent conveying speed.

Further, in the sheet cooling portion illustrated in FIG. 11, the cooling effect is improved by directly applying the cooling air to the sheet S. However, the cooling air is applied from one lateral side of the sheet S, and hence the cooling effect at a portion downstream of the cooling air becomes smaller than a portion upstream of the cooling air, resulting in being impossible to cool uniformly through the entire sheet. As a result, owing to the recent increase of the conveying speed, the cooling of the sheet, in particular, at the portion downstream of the cooling air becomes insufficient, resulting in being difficult to prevent the stains of the back surface of the sheet, or of the stick of the sheets to each other, which may occur at that portion.

SUMMARY OF THE INVENTION

Therefore, the present invention has been made in view of the above-mentioned circumstances, and has an object to provide an image forming apparatus capable of preventing stains of back surfaces of sheets, or stick of the sheets to each other, thereby being possible to ensure the image quality.

The present invention provides an image forming apparatus, comprising:

- a sheet conveying path through which a sheet having an image formed thereon passes;
- a first air blowing portion blowing an air on a side of a first surface of the sheet from a first lateral to a second lateral in a width direction intersecting with a sheet conveying direction of the sheet passing through the sheet conveying path; and
- a second air blowing portion blowing an air on a side of a second surface of the sheet, which is opposite to the first surface, from the second lateral to the first lateral of the sheet passing through the sheet conveying path.

As in the present invention, both surfaces of the sheet are cooled by blowing air along the first surface and the second surface of the sheet from opposed lateral sides of the sheet to each other, thereby being possible to effectively cool the sheets and to ensure the image quality.

Further features of the present invention will become apparent from the following description of exemplary embodiments with reference to the attached drawings.

DESCRIPTION OF THE EMBODIMENTS

Now, embodiments of the present invention are described in detail with reference to the drawings.

Figure 1:
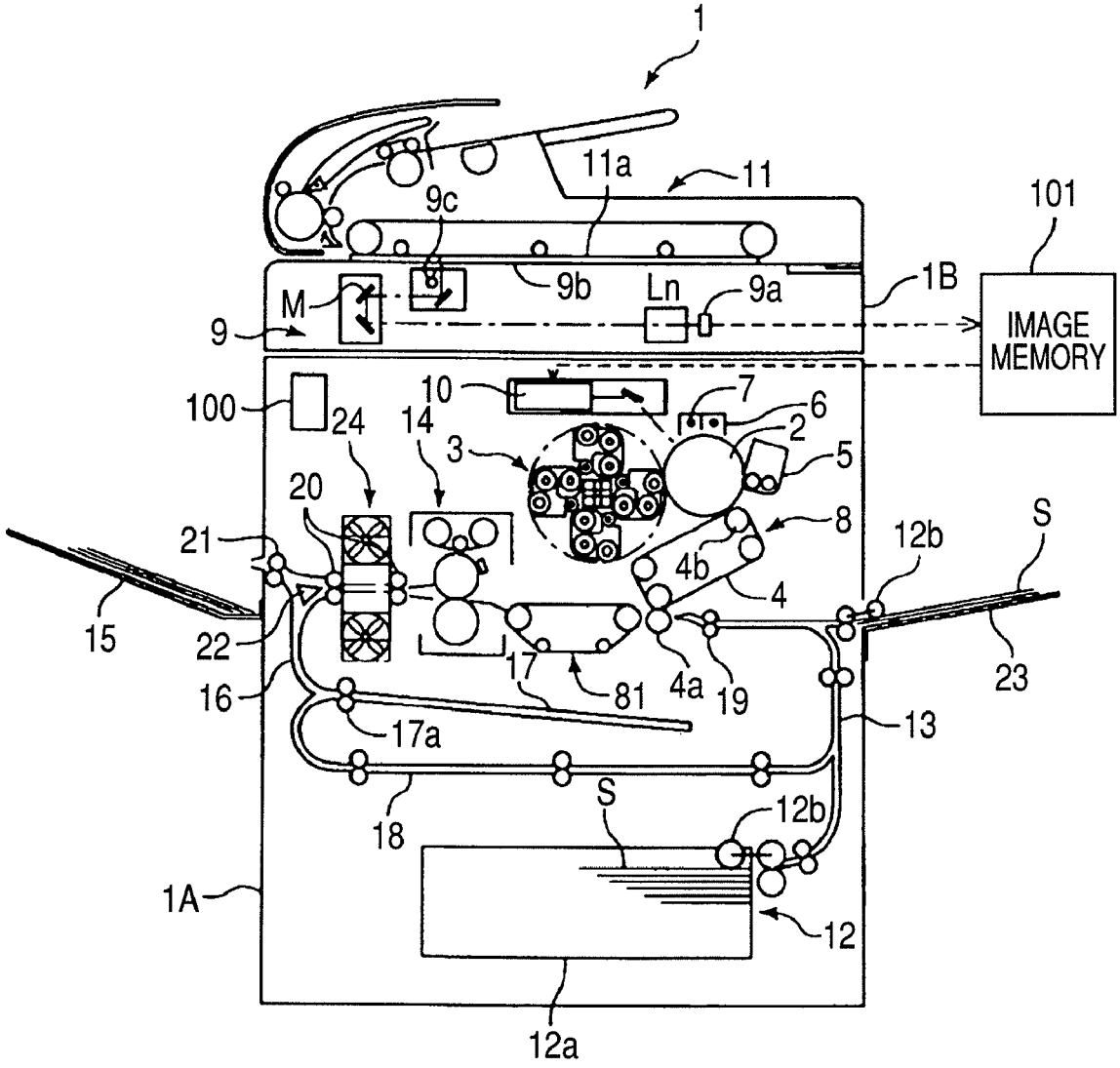
FIG. 1 illustrates a schematic structure of a color copying machine as an example of an image forming apparatus according to a first embodiment of the present invention.

FIG. 1 illustrates a schematic structure of a color copying machine as an example of an image forming apparatus according to a first embodiment of the present invention.

In FIG. 1, a color copying machine 1 includes a color copying apparatus main body (hereinafter referred to as an apparatus main body) 1A. On the apparatus main body 1A, there is provided an image reading portion 1B for reading an original placed on a platen glass 9*b* as an original placing stand by an automatic original feeder 11. Then, in the image reading portion 1B, a light source 9*c*, a mirror system M, a lens system Ln, and an optical reading system 9 including a CCD unit 9*a* are provided. A pressure plate 11*a* urges and presses the original placed on the platen glass 9*b*, against the platen glass 9*b*.

Further, below the image reading portion 1B, there are provided an image forming portion 8 and a sheet feeding portion 12 for feeding the sheet S to the image forming portion 8. In the image forming portion 8, there are arranged a photosensitive drum 2, a primary charger 7, a rotary developing device 3 containing a plurality of developing devices each being integrated with a toner cartridge, and a laser scanner unit 10.

Moreover, in the image forming portion 8, there are provided an endless transfer belt 4 to which four-color toner images are transferred and superimposed on top of the other to form a multi-color toner image, which is thereafter to be transferred onto the sheet S and a secondary transfer belt 4*a* for transferring the multi-color toner image from the transfer belt 4 to the sheet S. At a position that faces the photosensitive drum 2 via the transfer belt 4, there is arranged a primary transfer roller 4*b* as a primary transfer means for transferring the toner image formed on the photosensitive drum 2 onto the transfer belt 4, thereby forming a primary transfer portion. A cleaning device 5 removes the developer and other deposits remained on the drum 2. A charge eliminator 6 eliminates a residual charge on the drum 2.

In the sheet feeding portion 12, there are provided a cassette 12*a*, which contains the sheets S, and is detachably mounted to the apparatus main body 1A, and a manual insertion tray 23 for feeding a special sheet S such as OHT and a thick sheet of paper. A sheet S is supplied from the cassette 12*a* or the manual insertion tray 23 to the image forming portion 8.

Note that, on the downstream side of the image forming portion 8, there are provided a transferring and conveying device 81 for conveying the sheet S having a toner image transferred thereon, a fixing portion 14 for fixing an unfixed image, and an out-of-machine delivery roller 21 for delivering the sheet S having an image fixed thereon to an outside of the machine. Note that, in FIG. 1, a control device 100 controls an overall image forming operation of the apparatus main body 1A.

Next, a description will be provided of an operation of the color copying machine 1 having the structure described above.

If a signal is output from the control device 100 provided in the apparatus main body 1A, for example, an original placed on the platen glass 9*b* by the automatic original feeder 11 is irradiated with light from the light source 9*c* and reflects the light. Then, the reflected light from the original is once read out through a plurality of mirrors M and the lens Ln by a CCD unit 9*a* to be converted into an electrical signal, and the electrical signal is once recorded on an image memory 101. After that, from the laser scanner unit 10, a laser light corresponding to the electrical signal, or a laser light corresponding to data from the image memory 101 is irradiated onto the photosensitive drum 2.

Note that, at this time, the photosensitive drum 2 is charged in advance by the primary charger 7, and then irradiated with the light to form an electrostatic latent image on the photosensitive drum 2. Then, by a plurality of the developing device mounted on the rotary developing device 3, a toner image with a selected color is formed. After that, the toner image formed on the photosensitive drum 2 is transferred onto the transfer belt 4, at the primary transfer portion, through an action of a primary transfer bias voltage to be applied to the primary transfer roller 4*b*.

Here, in a case of a color mode, the transfer belt 4, on which the toner image is transferred, further rotates so that a next toner image is formed. Note that, during this period, the rotary developing device 3 rotates counterclockwise so that the developing device for a next designate color faces the photosensitive drum 2 for the preparation of development of a next electrostatic latent image. Thus, in a full color mode, an electrostatic latent image formation/development/transfer is repeated until the transfers of the toner images of a predetermined number of images are completed.

On the other hand, if a sheet feed signal is output from the control device 100, for example, a sheet S contained in the cassette 12*a* is conveyed to the registration roller 19 via a main body path 13 by a pickup roller 12*b*. Alternatively, a sheet S placed on the manual insertion tray 23 is conveyed to the registration roller 19 by a pickup roller 12*b*.

Then, a skew feed of the sheet S is corrected by the registration roller 19, and further timing is adjusted to send the sheet S to a secondary transfer portion defined by the transfer belt 4 as the image bearing member bearing the image and the secondary transfer roller 4*a*.

Next, the sheet S is thus sent to the secondary transfer portion in which the toner image is transferred onto the sheet S by the secondary transfer roller 4*a*. Thereafter the sheet S is conveyed to the fixing portion 14 by the transferring and conveying device 81. The fixing portion 14 heats and presses the sheet to permanently fix an unfixed transfer image onto the sheet S. Then, the sheet S having an image thus fixed thereon is delivered to the delivery tray 15 from the apparatus main body 1A by an inside delivery roller 20 and the out-of-machine delivery roller 21 constituting the sheet delivery portion.

Note that, the color copying machine 1 has a duplex image forming function, and if a duplex image forming mode is selected, the sheet S which passes the fixing portion 14 described above is once conveyed to a surface reversing path 17 through a sheet re-feeding and conveying path 16 by switching a switching member 22.

Here, at a timing in which a trailing edge of the sheet S passes the sheet re-feeding and conveying path 16 and the sheet S is still being nipped by reversing rollers 17*a*, the reversing rollers 17*a* effect a reverse rotation to convey the sheet S to a duplex path 18. After that, the sheet S is conveyed to the registration roller 19 through the duplex path 18 and again through a main body path 13, and then is conveyed through the similar route as in a case of one-side copying, and then is delivered to the delivery tray 15.

By the way, as illustrated in FIG. 1, the sheet cooling portion 24 is provided to the sheet conveying path between the fixing portion 14 and the out-of-machine delivery roller 21. The sheet heated at the fixing portion 14 is cooled by the sheet cooling portion 24.

Figure 2:
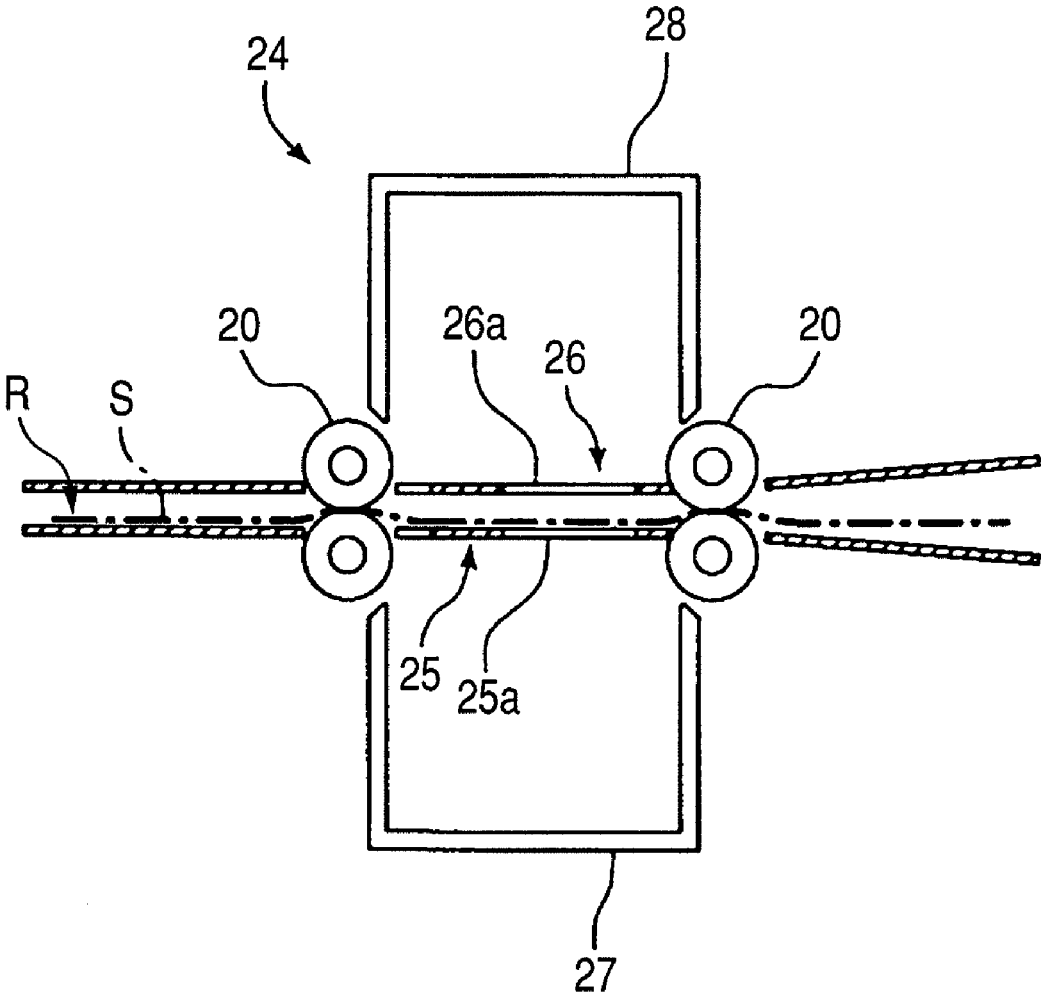
FIG. 2 illustrates a structure of a sheet cooling portion provided in the color copying machine.

The sheet conveying path on which the sheet cooling portion 24 is provided includes, as illustrated in FIG. 2, a lower guide plate 25 as a second guide member, and an upper guide plate 26 as a first guide member, which is provided opposite to the lower guide plate 25 so as to cooperate with the lower guide plate 25 to construct the sheet conveying path R. Then, ventilation holes 25*a* and 26*a* as communicating holes, for allowing the air to pass therethrough are formed substantially opposite to each other in the lower guide plate 25 and the upper guide plate 26, respectively.

Note that, in the embodiment, each of the ventilation holes 25*a* and 26*a* of the upper and lower plates 25 and 26 is formed in the shape of an elongated hole, which is elongated in the sheet conveying direction, lest the sheet S conveying through the sheet conveying path R is caught by the holes. Further, in the embodiment, a formation ratio (opening ratio) of the ventilation holes 25*a* and 26*a* with respect to the upper and lower plates 25 and 26, respectively, is set to a 50%.

Further, above the upper guide plate 26, an upper duct 28 as a first duct is extended along a direction (hereinafter referred to as a width direction) orthogonal to the sheet conveying direction. The upper duct 28 is opened on the sheet conveying path side so that the sheet conveying path R is communicated to the upper duct 28 via the ventilation hole 26*a* formed in the upper guide plate 26.

On the other hand, below the lower guide plate 25, a lower duct 27 as a second duct is extended along the width direction. The lower duct 27 is opened on the sheet conveying path side so that the sheet conveying path R is communicated to the lower duct 27 via the ventilation hole 25*a* formed in the lower guide plate 25. Note that, a gap between the upper guide plate 26 and the upper duct 28, and a gap between the lower guide plate 25 and the lower duct 27 are substantially sealed with the inside delivery roller 20.

Figure 3:
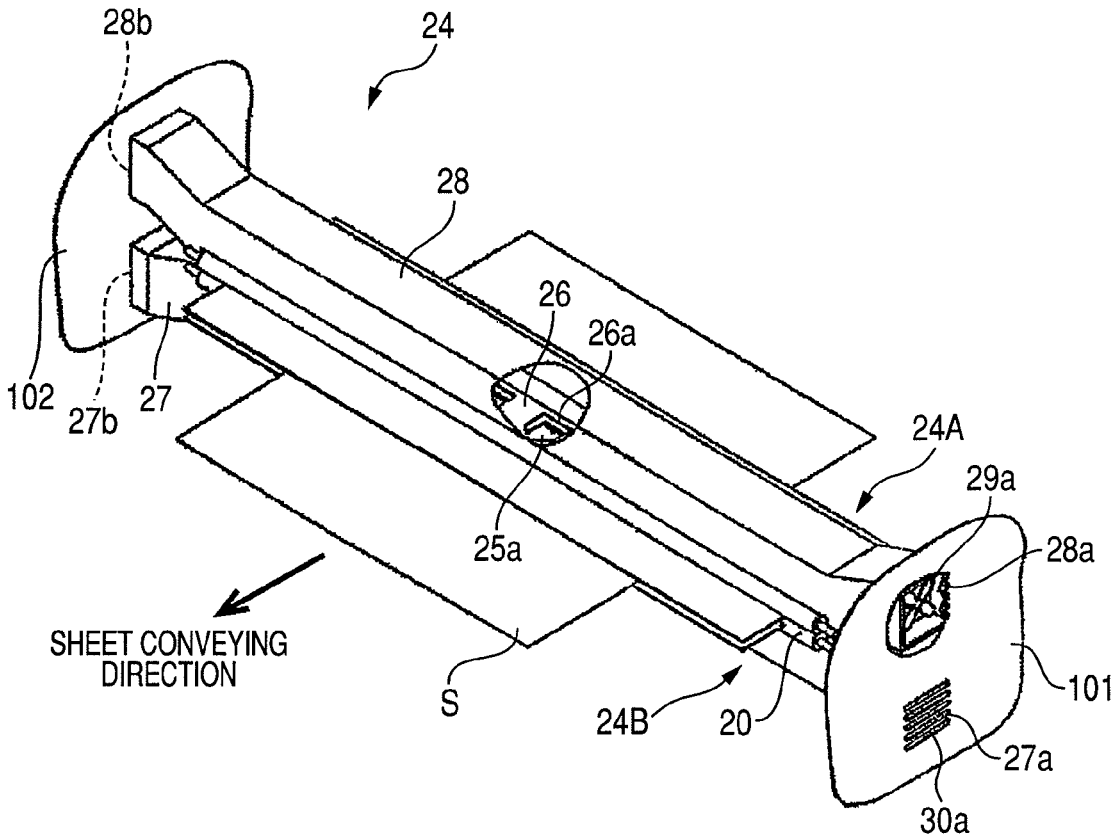
FIG. 3 is a perspective view illustrating the structure of the sheet cooling portion.

Further, the lower duct 27 includes, as illustrated in FIG. 3, opening portions 27*a* and 27*b* are formed in opposed side plates 101 and 102 of the apparatus main body 1A, respectively. Then, the opening portion 27*a* as an exhaust opening on one side is provided with a louver 30*a* formed with elongated holes. The opening portion 27*b* as an intake opening on the other side is provided with a second fan 29*b* illustrated in FIG. 4. The upper duct 28 includes opening portions 28*a* and 28*b* formed in the side plates 101 and 102. Then, the opening portion 28*a* as the intake opening on one side is provided with a first fan 29*a*. The opening portion 28*b* as the exhaust opening on the other side is provided with a louver (not shown) formed with elongated holes.

Here, the first fan 29*a* as the first air blowing member and the second fan 29*b* as a second air blowing member blow ambient air into the lower and upper ducts, respectively. Then, in the embodiment, the upper duct 28 and the first fan 29*a* construct a first air blowing portion 24A for blowing an air (ambient air) in the width direction along an upper surface (first surface) of the sheet S passing through the sheet conveying path R. Further, the lower duct 27 and the second fan 29*b* construct a second air blowing portion 24B for blowing an air (ambient air) in the width direction along a lower surface (second surface) opposite to the upper surface of the sheet S passing through the sheet conveying path R.

Figure 4:
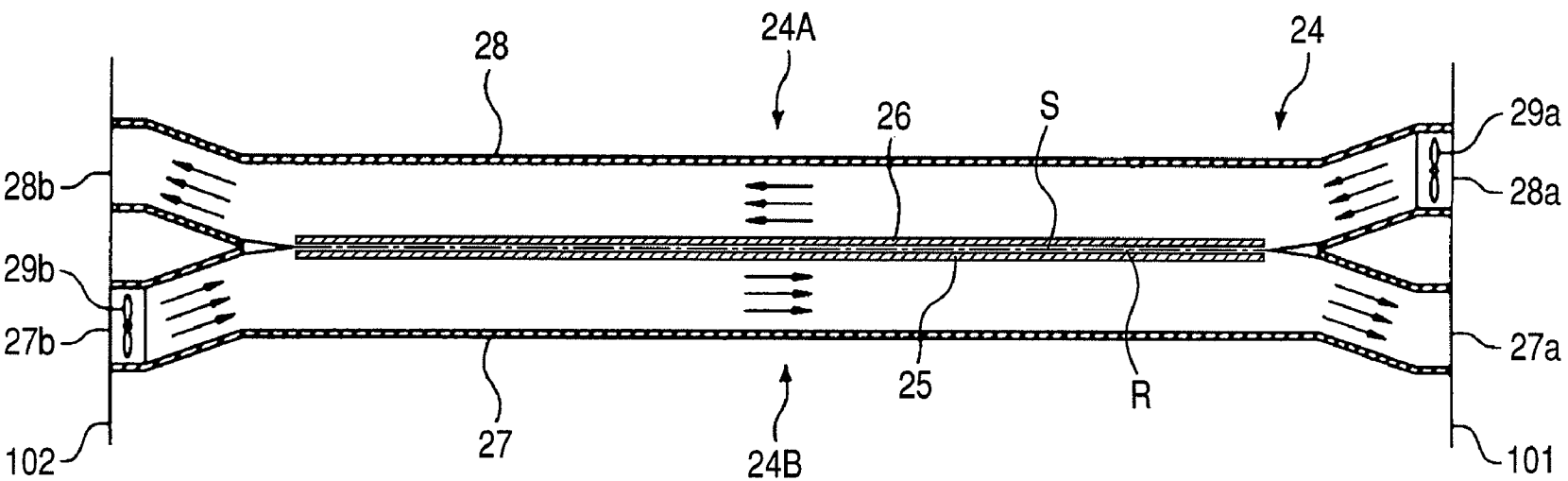
FIG. 4 is a side sectional view illustrating the structure of the sheet cooling portion.

Moreover, in the embodiment, the first fan 29*a* and the second fan 29*b* are fixed to the lower duct 27 and the upper duct 28, respectively, with the fixing positions thereof being opposed as illustrated in FIG. 4. Specifically, the first fan 29*a* is fixed to the one side plate 101 of the opposed side plates 101 and 102, and the second fan 29*b* is fixed to the other side plate 102 of the opposed side plates 101 and 102.

Then, by reversing the fixing positions of the first fan 29*a* and the second fan 29*b* as described above, the directions of the ambient air blown into the lower duct (the second duct) and into the upper duct (the first duct) are reversed.

In other words, the air in the upper duct 28 is flowed from one lateral side (a first lateral) of the sheet to the other lateral side (a second lateral). Further, the air in the lower duct 27 is flowed from the second lateral to the first lateral of the sheet. Here, the lateral of the sheet refers to a direction orthogonal to the sheet conveying direction. Note that, in the embodiment, regarding airflow rates of the first fan 29*a* and the second fan 29*b*, it is set such that the airflow rate of the second fan 29*b* provided in the lower duct 27 is larger than the airflow rate of the first fan 29*a* provided in the upper duct 28.

Next, a description will be provided of a sheet cooling operation of a sheet cooling portion 24 thus constructed.

When the conveyance of the sheet S starts, operations of the first fan 29*a* of the upper duct 28 and the second fan 29*b* of the lower duct 27 are started to blow air into the lower and upper ducts in reverse directions, respectively, as illustrated in FIG. 4. With this, the lower and upper ducts are filled with fresh air outside the apparatus main body.

After that, the sheet S, which is conveyed to the fixing portion 14 and is heat-fixed by the fixing portion 14 is conveyed to the sheet conveying path R as illustrated in FIG. 2. At this time, the ambient air flowing through the lower duct 27 and the upper duct 28 is allowed to flow into the sheet conveying path R from the above and the below because the sheet conveying path R is communicated to the lower duct 27 and the upper duct 28 via the ventilation holes 25*a* and 26*a* formed in the lower and upper guide plates 25 and 26.

With this, the ambient air flowing through the lower and the upper ducts is allowed to flow in the width direction along the both surfaces of the sheet S, thereby cooling the sheet S directly. Note that, the sheet S, which is cooled by the lower duct 27 and the upper duct 28 as described above, is delivered from the sheet delivering portion to be stacked on the delivery tray 15.

According to the embodiment, the sheet S can effectively be cooled by directly cooling the sheet S. Further, the lower duct 27 and the upper duct 28 are extended along the width direction, and hence the ambient air flowing in the lower and upper ducts is allowed to contact with the sheet over the entire length in the width direction of the sheet S by the shortest distance, thereby being capable of cooling the entire sheet and resulting in an improvement of a cooling effect for the sheet S.

Note that, the ambient air, which is warmed through the cooling of the sheet S, is discharged from the opening portion 27*a* and 28*b* as the exhaust opening illustrated in FIG. 4 to the outside of the apparatus main body. Accordingly, there occurs no temperature increase within the lower and upper ducts, thereby being held at substantially the same temperature as the ambient air. As a result, even if images are formed on the sheets successively, it is possible to secure a stable cooling effect for the sheets S.

Moreover, as in the embodiment, the both front and back surfaces of the sheet S conveying through the sheet conveying path R are cooled by the ambient air (air) blown out of the lower duct 27 and the upper duct 28 so that the sheet S is cooled more effectively. As a result, the temperature of the delivered sheet may be lowered more, whereby prevention effects of the stains of the back surface of the sheet, and the stick of the sheets to each other after delivery may be improved.

Note that, as described above, in the embodiment, the first fan 29*a* of the upper duct 28 and the second fan 29*b* of the lower duct 27 are arranged at different end portions (refer to FIG. 4). Here, in the vicinity of each of the fan 29*a* in the upper duct 28 and the fan 29*b* in the lower duct 27, the flow rate is larger and the temperature of the air itself is lower, whereby the larger sheet cooling effect is obtained. On the other hand, in a distant part of each of the fan 29*a* in the upper duct 28 and the fan 29*b* in the lower duct 27, the flow rate is smaller due to the influence of resistance and the temperature of the air itself is higher due to the increase in temperature with cooling the sheet, whereby the cooling effect is small.

However, in the embodiment, in the lower duct 27 and the upper duct 28, the air flow directions of the first fan 29*a* and the second fan 29*b* are directed reversely to each other. Accordingly, the larger side and smaller side of the sheet cooling effects are also reversed to each other between the upper and the lower ducts. Therefore, the sheet S is substantially uniformly cooled with respect to the air blowing directions in the lower duct 27 and the upper duct 28. Then, if the sheet S is uniformly cooled as described above, there occurs no local temperature increases of the sheet S at the delivery of the sheet S. As a result, the stains of the back surface of the delivered sheet S, or the stick of the sheets S hardly occur.

Moreover, in the embodiment, the air flow directions of the first fan 29*a* and the second fan 29*b*, as described above, are set so that the air is blown from the outside of the apparatus main body into the lower and upper ducts. Then, in a case of constructing as described above, the airflow rate becomes larger compared to a case where the air flow directions of the fans are set so that the air is blown from the ducts to the outside, thereby enhancing the sheet cooling effect.

Further, in the embodiment, the sheet S, which is heat-fixed by the fixing portion 14, and becomes high in temperature, is cooled. However, in this case, a temperature difference between the sheet S and the cooling air of the ambient air is large. Here, the cooling effect is generally large as the temperature difference between one for cooling and one to be cooled is large as possible. Thus, the sheet cooling effect in the embodiment becomes larger.

Moreover, in the embodiment, the airflow rate of the second fan 29*b* of the lower duct 27 is made larger than the airflow rate of the first fan 29*a* of the upper duct 28. In general, when the sheet S is conveyed through the sheet conveying path R, the sheet S is conveyed while sliding on the lower guide plate. Accordingly, when being conveyed, the lower side of the sheet is hard to contact with the blowing air from the duct, and hence the cooling effect is lowered compared to the upper side of the sheet. For this reason, in the embodiment, the airflow rate of the second fan 29*b* of the lower duct 27 is made larger than that of the first fan 29*a*, thereby being capable of uniformly cooling the upper side and the lower side of the sheet.

As described above, in the embodiment, the ambient air is flowed in the width direction along the both front and back surfaces of the sheet S passing through the sheet conveying path R, to thereby cool the both surfaces of the sheet S. As a result, it is possible to effectively cool the sheet S. With this operation, prevention of the stains of the back surface of the sheet, or of the stick of the sheets to each other, which may occur after the sheet delivery, can be achieved, thereby being possible to ensure the image quality.

Note that, in the embodiment, the opening ratio of the ventilation holes 25*a* and 26*a* with respect to the lower and upper guide plates 25 and 26 is set to a 50%. However, the opening ratio may not be limited to this. Further, in the embodiment, in order to uniformly cool the sheet S, the airflow rate of the second fan 29*b* of the lower duct 27 is made larger than the airflow rate of the first fan 29*a* of the upper duct 28. However, the cooling method for uniformly cooling the sheet is not limited to this way. For example, even if the airflow rates (capacities) of the fans 29*a* and 29*b* are the same as one another, the airflow rate of the lower duct 27 may be made larger than the airflow rate of the upper duct 28 by enlarging the opening ratio of the ventilation holes 25*a* of the lower guide plate 25 than the opening ratio of the ventilation holes 26*a* of the upper guide plate 26.

Next, a description will be provided of a second embodiment of the present invention.

Figure 5:
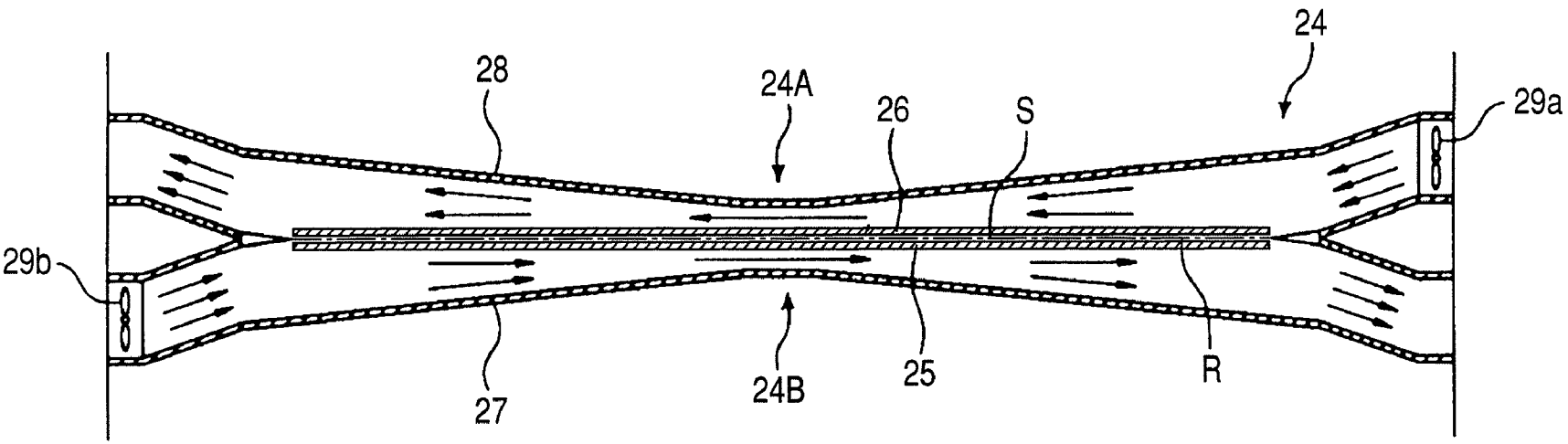
FIG. 5 illustrates a sheet cooling portion provided in an image forming apparatus according to a second embodiment of the present invention.

FIG. 5 illustrates a sheet cooling portion provided in an image forming apparatus according to the second embodiment of the present invention. It should be noted that, in FIG. 5, the same reference numerals used in FIG. 4 denote the same or equivalent parts.

In the embodiment, vertical spaces between the lower duct 27 and the lower guide 25 and vertical spaces between the upper duct 28 and the upper guide 26 are set so that the vertical spaces of the center portions of the lower duct 27 and the upper duct 28 are smaller than the vertical spaces of the both end portions thereof. In other words, in the embodiment, the lower duct 27 and the upper duct 28 are formed so that distances from the lower and upper ducts 28 to the sheet conveying path R are the smallest at the center portions thereof, and distances are the largest at the end portions thereof. Therefore the opening area of the upper duct 28 on the center portions in the width direction is smaller than on the side of the first fan 29*a*, the opening area of the lower duct 27 on the center portions in the width direction is smaller than on the side of the second fan 29*b*.

If the ambient air is blown into the lower and upper ducts thus constructed by the fans 29*a* and 29*b*, the distance between the lower and upper ducts 27, 28, and the lower and upper guides 25 and 26 (the sheet conveying path R) get progressively smaller, whereby speeds of the ambient air flowing in the lower and upper guides are gradually increased.

Then, at the center portions of the lower duct 27 and the upper duct 28, at which the distances to the sheet conveying path R are the smallest, the airflow rates become the largest. Note that, the airflow rate becomes gradually smaller due to the resistance. However, in the embodiment, the shape of the lower duct 27 and the upper duct 28 is configured so that the airflow rate increasing effect owing to shortening of the distance to the sheet conveying path R is made higher than the decrease of the airflow rate due to the resistance.

Here, if the sheet S is cooled, the temperature of the ambient air flowing through the lower duct 27 and the upper duct 28 rises, and hence the cooling effect for the sheet S becomes gradually smaller. However, as in the embodiment, the airflow rate becomes the fastest at the center portions of the lower duct 27 and the upper duct 28, whereby the cooling effect for the sheet S increases. As a result, the cooling effect for the sheet S by the ambient air is not totally lowered, and the sheet S may be cooled more uniformly.

Note that, in the embodiment, the distances to the sheet conveying path R are the smallest at the center portions of the lower duct 27 and the upper duct 28. However, the shapes of the lower duct 27 and the upper duct 28 are not limited to the above-described shapes. The shape may be configured such that at a portion or the entire portions of the ducts from the end portions of the lower duct 27 and the upper duct 28 to the center portions thereof, the distance to the sheet conveying path R gets progressively smaller from the end portions to the center portions thereof.

Figure 6A:
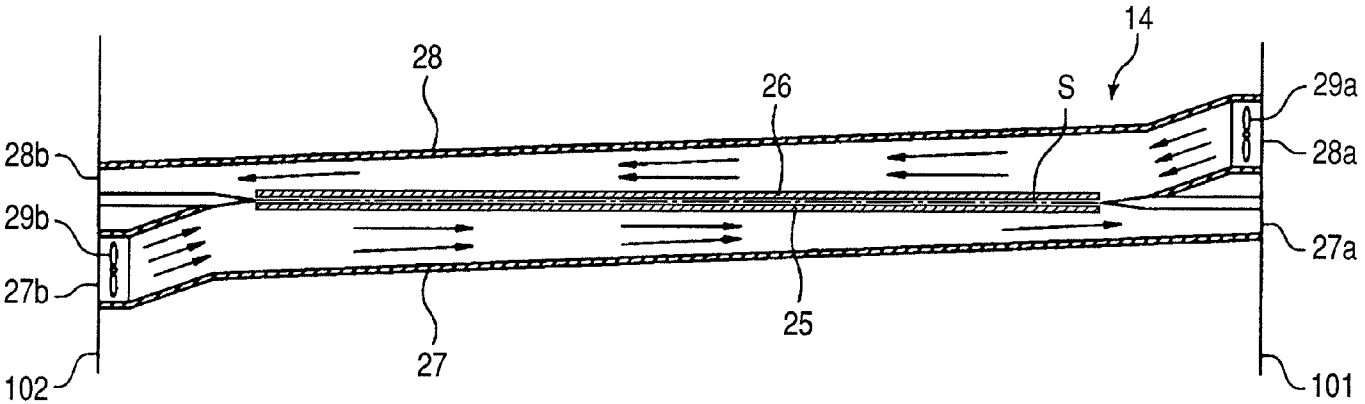
FIGS. 6A and 6B each illustrates another structure according to the second embodiment of the present invention.
Figure 6B:
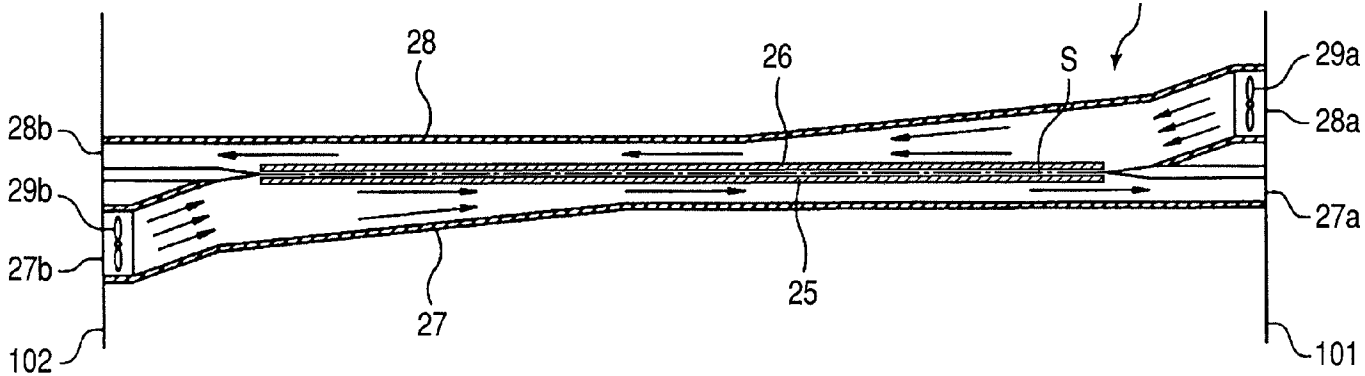

For example, as illustrate in FIG. 6A, the lower duct 27 and the upper duct 28 may be configured such that the distances from the sheet conveying path R get progressively smaller from the opening portions 28*a* and 27*b* as the intake opening to the opening portion 27*a* and 28*b* as the exhaust opening. Further, as illustrated in FIG. 6B, the lower duct 27 and the upper duct 28 may be configured such that the distances from the sheet conveying path R get progressively smaller from the opening portions 28*a* and 27*b* to the center portion thereof, and the distances from the sheet conveying path R remain the same between the center portions thereof and the opening portions 27*a* and 28*b*.

Next, a description will be provided of a third embodiment of the present invention.

Figure 7A:
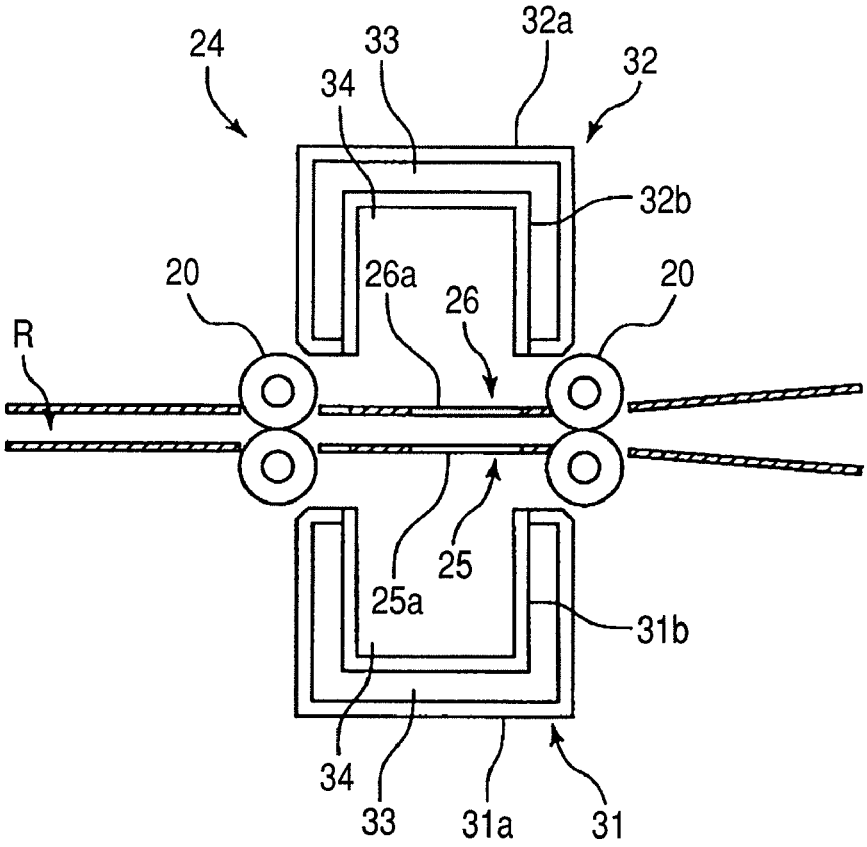
FIGS. 7A and 7B illustrate a structure of a sheet cooling portion provided in an image forming apparatus according to a third embodiment of the present invention.
Figure 7B:
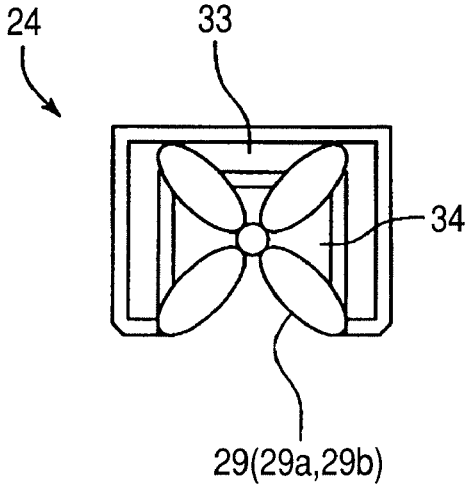

FIGS. 7A and 7B illustrate a structure of a sheet cooling portion provided in an image forming apparatus according to the third embodiment of the present invention. It should be noted that, in FIGS. 7A and 7B, the same reference numerals used in FIG. 2 denote the same or equivalent parts.

In FIGS. 7A and 7B, lower and upper ducts 31 and 32 each is formed in a double structure including an outer duct 31*a*, 32*a* as a first duct member and an inner duct 31*b*, 32*b* as a second duct member arranged inside the outer duct 31*a*, 32*a*.

Note that, in FIGS. 7A and 7B, first air flow paths 33 are spaces formed between the outer ducts 31*a*, 32*a* and the inner ducts 31*b*, 32*b*. Second air flow paths 34 are spaces formed between the inner ducts 31*b*, 32*b* and the lower and upper guides 25 and 26.

Then, as illustrated in FIG. 7B, the ambient air is simultaneously blown to the first air flow path 33 and the second air flow path 34 by the fan 29 (29*a* and 29*b*). Here, the ambient air flowing through the first air flow path 33 serves as an air curtain for the second air flow path 34. The ambient air flowing through the first air flow path 33 provides thermal isolation between the ambient air flowing through the second air flow path 34 and the ambient environment. Then, as the second air flow path 34 is thermally insulated from the ambient environment, the second air flow path 34 may cool the sheet S without being influenced with the ambient temperature environment of the lower and upper ducts 31 and 32.

In particular, in a case where the lower and upper ducts 31 and 32 are arranged close to the fixing portion 14, the temperatures of the lower and upper ducts 31 and 32 themselves become higher due to radiation heat from the fixing portion 14, resulting in influencing the cooling effect of the sheet S to lower.

However, as in the embodiment, by forming each of the lower and upper ducts 31 and 32 into the double structure to thereby blocking the radiation heat from the fixing portion 14 by the first air flow path 33, the ambient air flowing through the second path 34 may not be influenced by the radiation heat from the fixing portion 14. As a result, a sufficient sheet cooling effect may be exerted.

Figure 8:
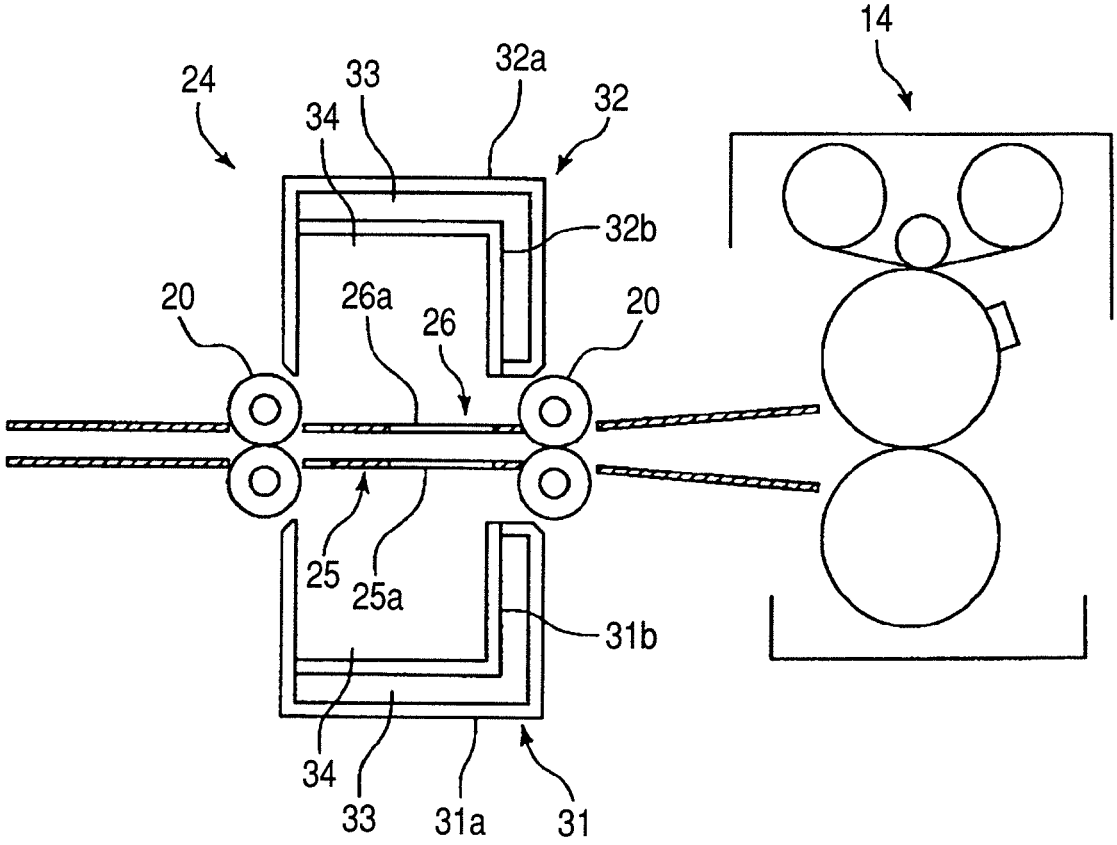
FIG. 8 illustrates another structure of the sheet cooling portion according to the third embodiment of the present invention.
Figure 9:
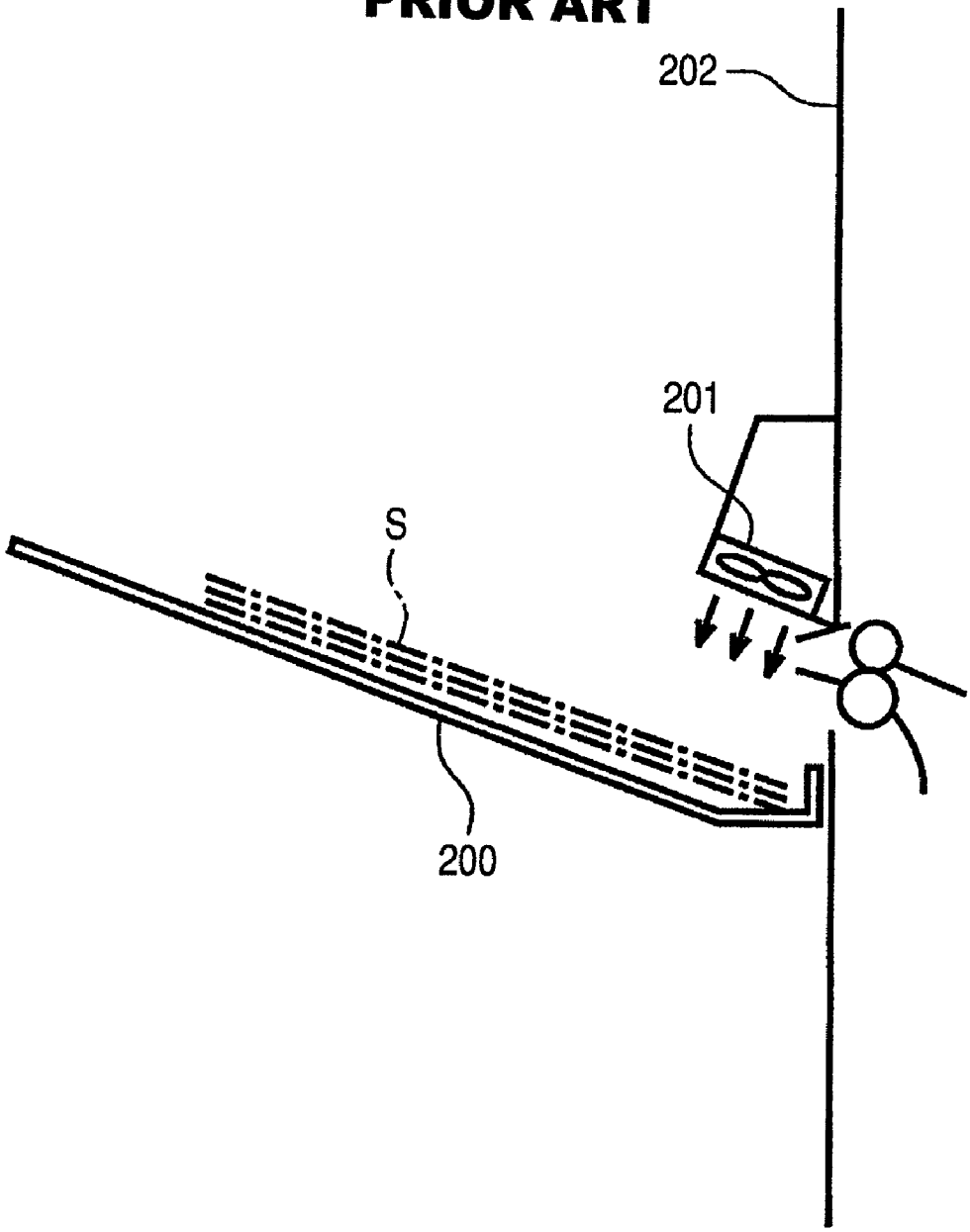
FIG. 9 PRIOR ART
FIG. 9 is a perspective view illustrating a structure of a first conventional sheet cooling portion.
Figure 10:
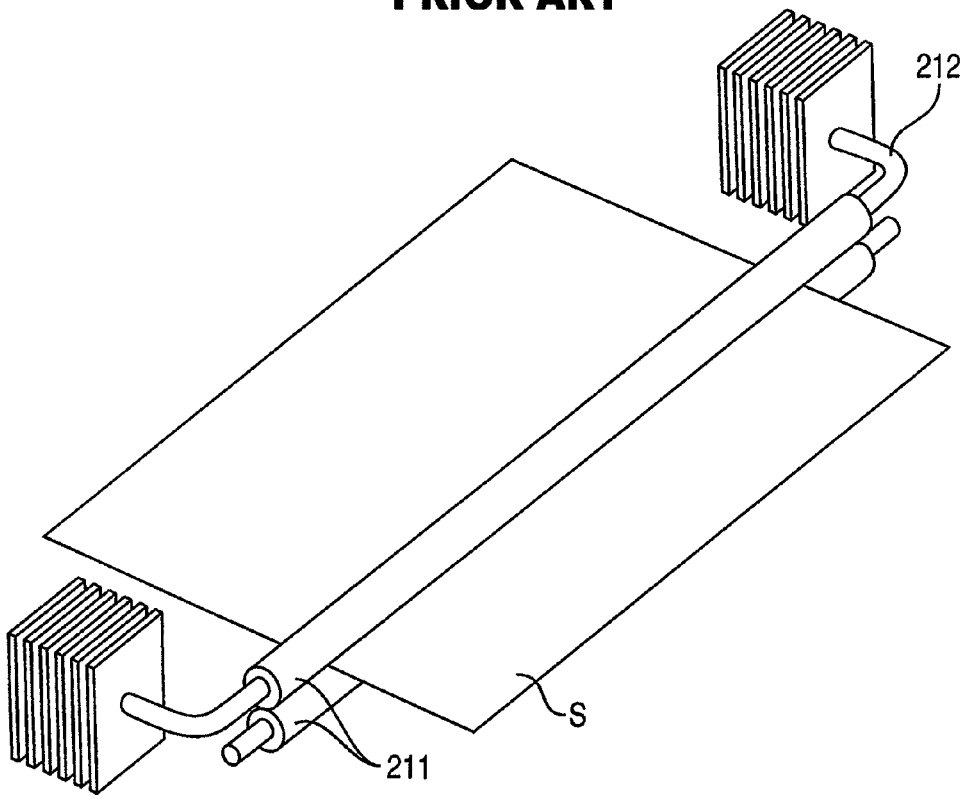
FIG. 10 PRIOR ART
FIG. 10 is a perspective view illustrating a structure of a second conventional sheet cooling portion.
Figure 11:
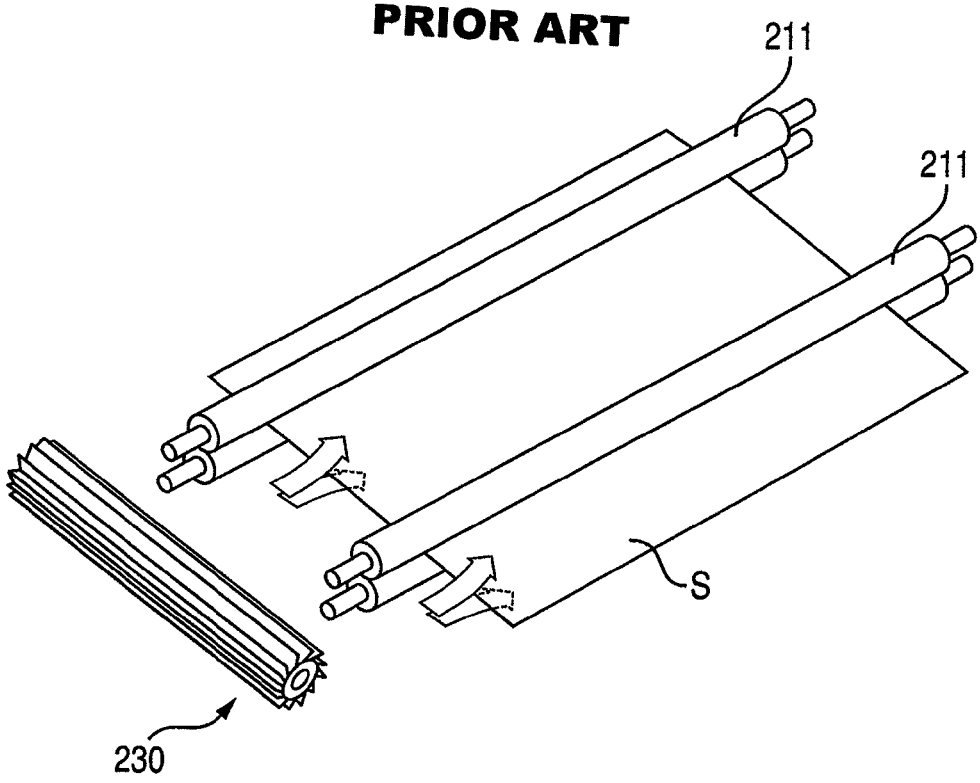
FIG. 11 PRIOR ART
FIG. 11 is a perspective view illustrating a structure of a third conventional sheet cooling portion.

Note that, in the description described above, the outer ducts 31*a* and 32*a* are arranged so as to cover the inner ducts 31*b* and 32*b*. However, a positional relationship between the inner ducts 31*b* and 32*b*, and the outer ducts 31*a* and 32*a* is not limited to the above construction. For example, as illustrated in FIG. 8, if there apparently exists an influencing heat source such as the fixing portion 14, the double structure portion of the dust may be formed only on the side of the heat source.

Note that, in any one of the above-mentioned embodiments, the embodiment in which the air flows in the upper duct and the lower duct in the direction orthogonal to the sheet conveying direction is described by way of example. However, the present invention is not always necessary to configure so that the air flows in the direction orthogonal to the sheet conveying direction. For example, the upper duct and the lower duct may be formed so that the air flows along the surface of the conveying sheet and in a direction inclined with respect to the sheet conveying direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-097198, filed Apr. 3, 2008, which is hereby incorporated by reference in its entirety.

What is claimed is:

1. An image forming apparatus comprising:

a sheet conveying path through which a sheet having an image formed thereon passes;

a first air blowing portion blowing air along a first surface of the sheet from a first lateral side to a second lateral side in a width direction intersecting with a sheet conveying direction of the sheet passing through the sheet conveying path, the first air blowing portion including:

a first duct extending in the direction intersecting with the sheet conveying direction, and communicating to the sheet conveying path; and a first air blowing member for blowing air into the first duct; and a second air blowing portion blowing air along a second surface of the sheet, which is opposite to the first surface, from the second lateral side to the first lateral side of the sheet passing through the sheet conveying path, the second air blowing portion including:

a second duct extending in the direction intersecting with the sheet conveying direction, and communicating to the sheet conveying path; and a second air blowing member for blowing air into the second duct in a direction reverse to the first air blowing member, wherein an air flowing space of the first duct through which air is flowed and an air flowing space of the second duct through which air is flowed overlap each other in a view of a direction perpendicular to the surface of the sheet which passes through the conveying path.

2. An image forming apparatus comprising:

a sheet conveying path through which a sheet having an image formed thereon passes;

a first air blowing portion blowing air along a first surface of the sheet from a first lateral side to a second lateral side in a width direction intersecting with a sheet conveying direction of the sheet passing through the sheet conveying path, the first air blowing portion including:

a first duct extending in the direction intersecting with the sheet conveying direction, and communicating to the sheet conveying path; and a first air blowing member for blowing air into the first duct; and a second air blowing portion blowing air along a second surface of the sheet, which is opposite to the first surface, from the second lateral side to the first lateral side of the sheet passing through the sheet conveying path, the second air blowing portion including:

a second duct extending in the direction intersecting with the sheet conveying direction, and communicating to the sheet conveying path; and a second air blowing member for blowing air into the second duct in a direction reverse to the first air blowing member, wherein an intake opening of the first duct and an exhaust opening of the second duct are provided in one of opposed side plates of an apparatus main body, and an exhaust opening of the first duct and an intake opening of the second duct are provided in the other of the opposed side plates of the apparatus main body; and wherein the first air blowing member is provided in the intake opening of the first duct and the second air blowing member is provided in the intake opening of the second duct.

3. An image forming apparatus comprising:

a sheet conveying path through which a sheet having an image formed thereon passes;

a first air blowing portion blowing air along a fist surface of the sheet from a first lateral side to a second lateral side in a width direction intersecting with a sheet conveying direction of the sheet passing through the sheet conveying path, the first air blowing portion including:

a first duct extending in the direction intersecting with the sheet conveying direction, and communicating to the sheet conveying path; and a first air blowing member for blowing air into the first duct;

a second air blowing portion blowing air along a second surface of the sheet, which is opposite to the first surface, from the second lateral side to the first lateral side of the sheet passing through the sheet conveying path, the second air blowing portion including:

a second duct extending in the direction intersecting with the sheet conveying direction, and communicating to the sheet conveying path; and a second air blowing member for blowing air into the second duct in a direction reverse to the first air blowing member;

a first guide member, which forms the sheet conveying path, and is provided with a communicating hole communicating to the first duct; and a second guide member, which is provided opposite to the first guide member to form the sheet conveying path in cooperation with the first guide member, and is provided with a communicating hole communicating to the second duct, wherein an amount of the air flowing through one of the first and second ducts communicating to one of the first and second guide members on which the sheet passing through the sheet conveying path slides is greater than an amount of the air flowing through the other of the first and second ducts.

4. An image forming apparatus comprising:

a sheet conveying path through which a sheet having an image formed thereon passes;

a first air blowing portion blowing air along a first surface of the sheet from a first lateral side to a second lateral side in a width direction intersecting with a sheet conveying direction of the sheet passing through the sheet conveying path, the first air blowing portion including:

a first duct extending in the direction intersecting with the sheet conveying direction, and communicating to the sheet conveying path; and a first air blowing member for blowing air into the first duct; and a second air blowing portion blowing air along a second surface of the sheet, which is opposite to the first surface, from the second lateral side to the first lateral side of the sheet passing through the sheet conveying path, the second air blowing portion including:

a second duct extending in the direction intersecting with the sheet conveying direction, and communicating to the sheet conveying path, and a second air blowing member for blowing air into the second duct in a direction reverse to the first air blowing member, wherein an opening area of the first duct on a center portion in the width direction is smaller than on the first lateral side, an opening area of the second duct on a center portion in the width direction is smaller than on the second lateral side.

5. An image forming apparatus according to claim 1, wherein each of the first duct and the second duct comprises a first duct member and a second duct member disposed inside the first duct member, and wherein the first air blowing member and the second air blowing member blows the air into a space between the first duct member and the second duct member, and into a space between the second duct member and the sheet conveying path.

6. An image forming apparatus according to claim 2, wherein each of the first duct and the second duct comprises a first duct member and a second duct member disposed inside the first duct member, and wherein the first air blowing member and the second air blowing member blows the air into a space between the first duct member and the second duct member, and into a space between the second duct member and the sheet conveying path.

7. An image forming apparatus according to claim 3, wherein each of the first duct and the second duct comprises a first duct member and a second duct member disposed inside the first duct member, and wherein the first air blowing member and the second air blowing member blows the air into a space between the first duct member and the second duct member, and into a space between the second duct member and the sheet conveying path.

8. An image forming apparatus according to claim 4, wherein each of the first duct and the second duct comprises a first duct member and a second duct member disposed inside the first duct member, and wherein the first air blowing member and the second air blowing member blows the air into a space between the first duct member and the second duct member, and into a space between the second duct member and the sheet conveying path.

* * * * *